United States Patent [19]

Patton

[11] Patent Number: 4,734,337

[45] Date of Patent: Mar. 29, 1988

[54] HIGHLY-OPEN LONGITUDINALLY-STIFF, EXPANDED METAL PRODUCT

[75] Inventor: John M. Patton, Ontario, Calif.

[73] Assignee: Triton Group Ltd., La Jolla, Calif.

[21] Appl. No.: 908,174

[22] Filed: Sep. 16, 1986

[51] Int. Cl.[4] ..... E04F 13/04

[52] U.S. Cl. ..... 428/595; 52/342; 52/672; 428/596

[58] Field of Search ..... 428/596, 593; 52/670, 52/671, 672, 342

[56] References Cited

U.S. PATENT DOCUMENTS

| | | | |
|---|---|---|---|
| 1,104,475 | 7/1914 | Clark | 52/671 |
| 1,104,476 | 7/1914 | Clark | 52/672 |
| 1,320,332 | 10/1919 | Coach | 52/672 |
| 1,419,709 | 6/1922 | Ackermann | 52/672 |
| 1,537,588 | 5/1925 | Curtis | 52/672 |
| 1,618,666 | 2/1927 | Manofsky | 52/670 |
| 1,762,322 | 6/1930 | Baker | 52/672 |

FOREIGN PATENT DOCUMENTS

| | | | |
|---|---|---|---|
| 102149 | 7/1965 | Denmark | 52/672 |
| 2222583 | 11/1973 | Fed. Rep. of Germany | 52/671 |

OTHER PUBLICATIONS

"Rib-Lath and Rib Studs", brochure by Trussed Concrete Steel Co., Detroit, Mi. 1909, pp. 1-23.

Amico Standard Metal Lath Products, p. 2, Alabama Metal Industries Corp., date unknown.

"Amico-One Source". . . , 4 pages, Alabama Metal Industries Corp., 1986.

Tecnical Bulletin No. 101, Metal Lath/Steel Framing Assn., 6 pages, 1978.

"Western Paper Backed Metal Lath", Western Metal Lath Company, 4 pages, 1985.

Cemco catalog, p. 19, California Expanded Metal Co., date unknown.

*Primary Examiner*—John J. Zimmerman

*Attorney, Agent, or Firm*—Christie, Parker & Hale

[57] ABSTRACT

A sheet of expanded metal lath has expanded longitudinal edge margins between which the metal sheet is selectively expanded transversely of the sheet length to define plural parallel rows of trapezoidal openings having long sides of about one inch and widths perpendicular to the long sides of about 7/32 inch. Between the selected rows of the openings, the sheet defines corresponding ones of plural rib constructions, each of which has a generally "Z" transverse cross-sectional configuration having substantially parallel non-coplaner and non-overlapping rib edge portions interconnected by a rib central portion disposed oblique to the rib edge portions. Where the unexpended thickness of the sheet is substantially 0.015 inch, the expanded metal sheet has a weight of substantially 1.8 pounds per square yard. The article has about 70% "openness", yet has adequate resistance to bending about lines across its width due to the configuration of the ribs and the sheet edge margins.

15 Claims, 10 Drawing Figures

HIGHLY-OPEN LONGITUDINALLY-STIFF, EXPANDED METAL PRODUCT

FIELD OF THE INVENTION

This invention pertains to expanded metal lath and similar articles. More particularly, it pertains to expanded metal sheet which has a high degree of openness and which has adequate resistance to bending across its length due to an improved configuration of longitudinal stiffening ribs occurring at spaced locations across the width of the sheet.

REVIEW OF THE PROBLEM ADDRESSED

Expanded metal lath is an accepted product which is used in various ways in the construction industry, usually as a reinforcing substrate in connection with the application of plaster and other cementitous materials. Although the product of the present invention can be used in many specific contexts, its utility and advantages are described in the context of the application of plaster, stucco and the like to exterior walls of buildings of frame construction.

Expanded metal lath is usually is made by lancing a metal sheet having selected thickness, width and length dimensions, thus, to define in the sheet a plurality of slits. The slits, as created by the lancing process, usually are defined in plural rows arranged in a predetermined pattern relative to the length and width of the sheet, such as a parallel to the length of the sheet. In a given row, the slits are spaced from each other. The slits may be parallel to the length of the sheet, or they may be oblique to the sheet length; where the sheet is to be expanded across its width, the slits are not defined parallel to the width of the sheet. Where the slits are oblique to the length of the sheet, then all slits may be parallel to each other, or the slits in some rows may be angled appropriately to the slits in others of the rows.

After completion of the lancing process, the lanced sheet is subjected to forces acting transversely on the sheet; such forces can be applied in various ways. The transverse forces cause the metal between and adjacent the several slits to deform, thereby causing the slits to develop into openings in the sheet and causing the width of the sheet between the longitudinal edges to increase. The openings can be diamond shaped or trapezoidal, or they can have other shapes.

Such expanded metal lath sheets are used, among other ways, by securing them across the spaces defined between the studs or the like in the wall of a frame-construction building, and then by applying a rough coat of plaster (i.e. a base or "brown" layer) to the sheet. The applied plaster or other cementitious material penetrates into the openings in the lath sheet and flows at least partially around the metal between the adjacent openings so that, when the material sets hard, it is looked to and anchored in place by the lath sheet. Obviously, the size of the opening in the lath sheet cannot be too small, else the applied plaster or other material cannot penetrate into the opening under moderate applied force, or else excess force will be required to produce the penetration of the plaster into the openings. Neither can the openings be too large, else too much plaster will be pushed by moderate application force through the openings thus either wasting plaster or producing an inadequate anchor effect, or both.

In many instances, the initial application of plaster or other cementitious material to the expanded metal lath may be achieved largely by shooting the material onto the lath through a nozzle from a pump, followed by a light hand troweling of the material so applied. The force of the impingement of the cementitious material on the lath may be sufficiently high that the material tends to pass overly through the lath. Therefore it is known to affix, as by gluing, a sheet of paper to one side of the lath sheet, and to mount the lath to the studs and like with the paper disposed on the inside of the wall; the paper serves as a backstop for applied cementitous material to prevent the material, especially when shot or blown against the lath, from passing overly much through the lath, thereby preventing wastage of such material.

Depending upon whether wood or metal studs are used in frame construction, as well as upon other factors, the spacing between adjacent studs can be 16 inches, 24 inches, or perhaps more. When expanded metal lath is used across such studs to serve as a substrate and reinforcement for plaster and the like, it is very desirable that the lath sheet not deflect appreciably between adjacent studs as the initial coat of the plaster or the like is applied; such deflection is induced by the force of application of the plaster to the lath, whether the application is by hand or otherwise. Undesired deflection of the lath is wasteful of plaster, as it requires the use of more plaster than necessary, or it can produce unaesthetic ripple or peak-and-valley effects over an extended wall surface, or both. Therefore, it is known to the manufacture of expanded metal lath sheets to incorporate stiffening ribs which extend across the spaces between adjacent studs when the lath is properly mounted to the studs. Stiffening ribs can be defined by creasing the lath sheet after expansion, or the ribs can be formed in the lath stock metal before expansion in such a way that they remain after the expansion forces have been applied; in the latter instance, the ribs are defined by unlanced and unexpanded portions of the metal sheet.

The present industry standard size for expanded metal sheet is 27 inches, or 27.5 inches, wide by either 96 inches or 48 inches long.

Further, expanded metal lath sheet, as manufactured, must have sufficient structural integrity that it can be handled, frequently and often rather roughly, between the end of the manufacturing process to the time it has been mounted to studs or the like. This consideration, especially when coupled with the need for resistance of the lath to deflection between supporting studs when in use, means that the lath sheet cannot be made from too thin sheet metal stock, else the finished lath sheet will be too flimsy to be handled efficiently.

Conversely, the thicker the raw stock sheet metal, the heavier the finished lath sheet will be; if too heavy, it cannot be handled efficiently in the field.

The foregoing are the factors and considerations which pertain to expanded metal lath from the vantage point of the user of the product, such as a plastering contractor, and also, to a certain extent, from the vantage point of the lath manufacturer. The user of the lath sheet can benefit by the availability of larger lath sheets, provided the criteria of adequate structural integrity, for purposes of handling, and low weight, for ease of handling, are met. The larger the lath sheet, the fewer the number of sheets needed to lath a given area of wall, the faster the lather's phase of the project can be completed with a given work force, the lower the installer's labor costs, and the greater the installer's profit for a competitively priced job. The manufacturer of expanded metal lath can benefit, most other things being equal or comparable, by an ability to make lath having a low weight per unit area. A major factor in the economics of manufacture of expanded metal lath is raw material costs. The lower the weight per unit area of finished product, the lower the manufacture's cost per unit area, and thus either the greater his profit or the better his competitive position.

These factors and considerations show that a need exists for improved expanded metal lath having adequate resistance to deflection in use, adequate structural integrity to withstand rough handling between completion of manufacture and installation, increased size of finished lath sheet, and reduced weight per unit area of the manufactured lath sheet.

SUMMARY OF THE INVENTION

This invention addresses and meaningfully fulfills the need identified above. It provides, as an article of manufacture, expanded metal lath sheet which is wider than lath sheets heretofore provided, thus benefitting the user, which has adequate resistance to deflection in use and adequate structural integrity for convenient handling, and which has significantly reduced weight per unit area. An important aspect of the improved reinforcing lath sheet is an improved reinforcing rib construction which affords superior resistance of the lath sheet to bending about lines transversely of the lath sheet per unit thickness of raw sheet metal stock material. The lath sheet has a high degree of openness which is achieved by use of finished product openings which are large, but not so large that the lath sheet cannot effectively serve as a substrate and reinforcement for plaster and the like applied to the sheet in use.

Generally speaking, this invention provides, as an article of manufacture, expanded metal lath which is useful, among other ways as a construction material to serve as a substrate and reinforcement for plaster and the like applied to it. The article is provided as a substantially rectangular lanced and expanded metal sheet of selected length and width dimensions. The article has a width substantially greater than the unexpanded metal sheet from which the article is manufactured. The article has unexpanded edge margins of selected width along each longitudinal edge. The article, between the edge margins, defines longitudinal rows of similar substantially trapezoidally shaped openings, in which the long side of each opening is disposed substantially transversely of the article. The article defines, between the edge margins, a plurality of rib constructions which are disposed parallel to the edge margins. The rib constructions extend between the end of the article and are spaced at regular intervals across the width of the article between selected rows of opening. Each rib construction has along the length thereof a three dimensional stiffening contour which, in cross-section transversely of the length of the article, is of generally "Z" configuration having two spaced substantially parallel but non-coplanar and non-overlapping rib edge portions interconnected by a rib central portion disposed obliquely to the rib edge portions.

DESCRIPTION OF THE DRAWINGS

The above-mentioned and other features of this invention are more fully set forth in the following detailed description of a presently preferred embodiment of the invention, which description is presented with reference to the accompanying drawings, wherein:

FIG. 10 depicts the repeating pattern of lanced slits in the sheet metal stock.

DESCRIPTION OF THE ILLUSTRATED EMBODIMENT

Figure 1:
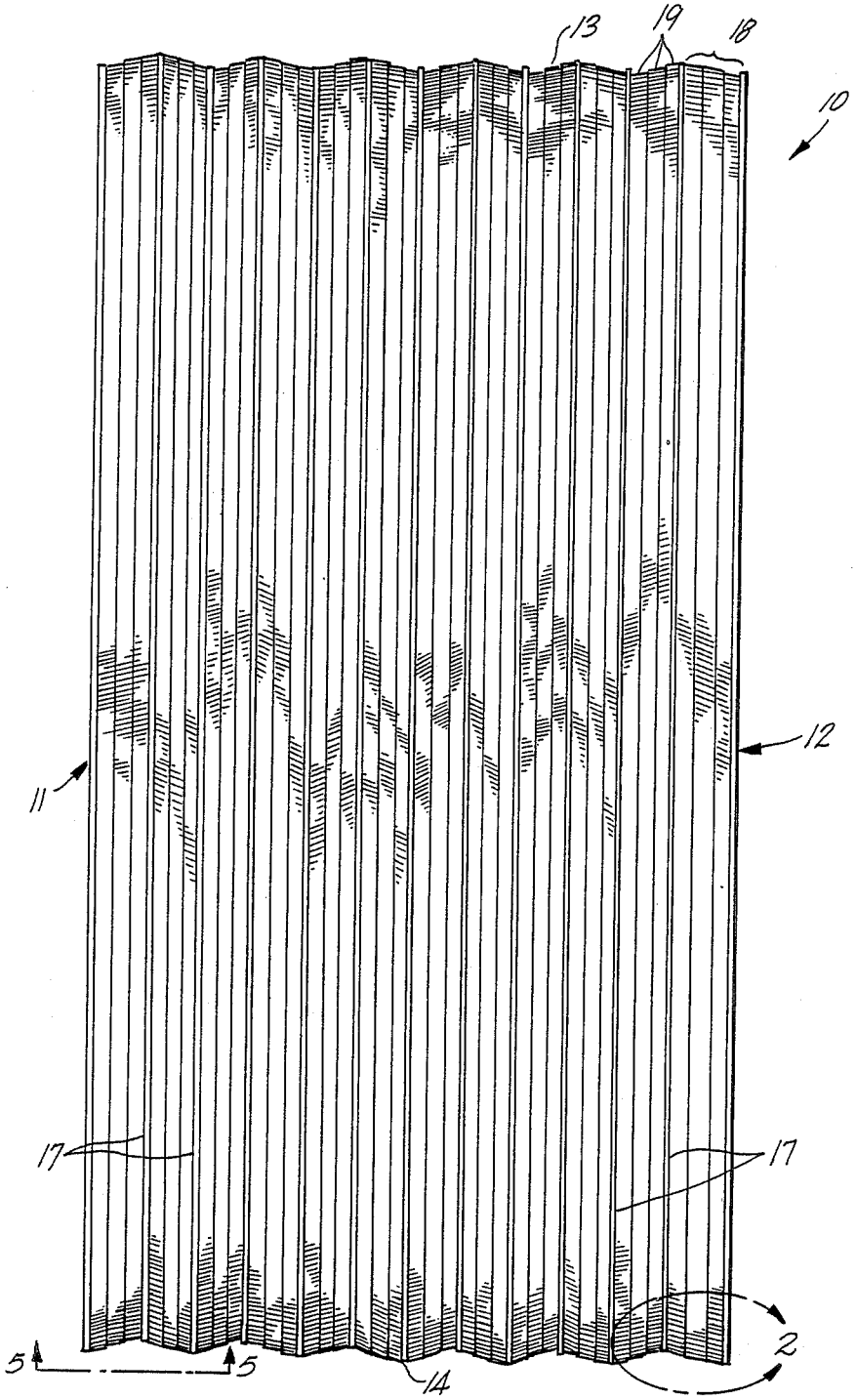
FIG. 1 is a simplified top plan view of a sheet of expanded metal lath according to this invention.

FIG. 1 is a top plan view of an expanded metal lath sheet 10 which is provided as an article of manufacture. The sheet is of rectangular configuration and, in the preferred embodiment illustrated, has a width of 36 inches between opposite longitudinal edge margins 11 and 12. The sheet has opposite ends 13 and 14 which, in the full sheet, are spaced 96 inches apart; a half-length form of expanded metal lath according to this invention has a length of 48 inches. Lath sheet 10 is manufactured by expansion, in the manner described below consistent with existing practice in the pertinent industry, from a piece 15 of sheet metal having a length corresponding to the length of lath sheet 10, but having an initial width of about 12⅜ inches. In the presently preferred embodiment of the invention shown in the accompanying drawings, stock sheet 15 has a thickness of 0.015 inches.

Lath sheet 10, as an article of manufacture in its presently preferred form, is characterized by the presence in the sheet of eleven longitudinal stiffening ribs 17 which are disposed parallel to the longitudinal side edge margins 11 and 12 and which are spaced at regular intervals between the edge margins transversely of the length of the sheet. Also, sheet 10 is characterized by twelve sets 18 of longitudinal rows 19 of openings 40 between adjacent ones of stiffening ribs 17 and between the outer stiffening ribs and the adjacent ones of edge margins 11 and 12. As shown best in FIGS. 2 and 3 there are three rows 19 of openings 40 in each set 18 of rows; however, greater or lesser numbers of rows of openings can be provided between the adjacent longitudinal stiffening ribs.

Figure 10:
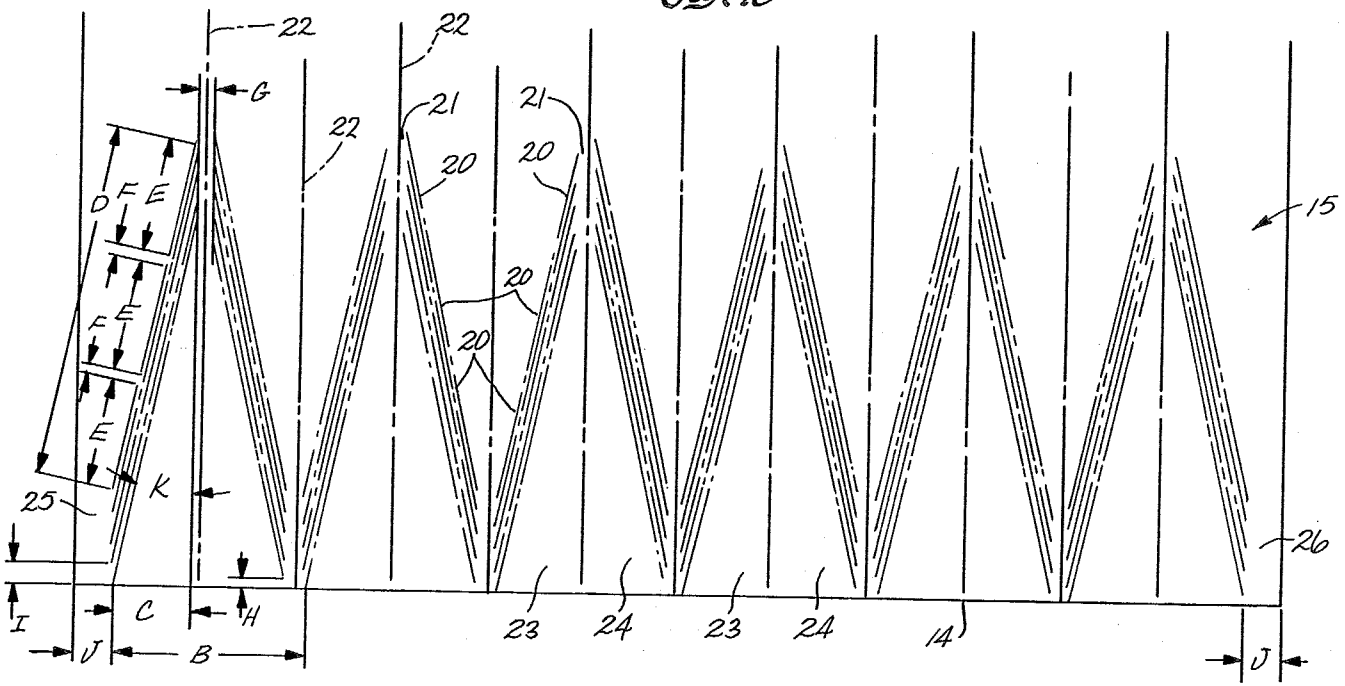
FIG. 10 is a simplified fragmentary plan view of a portion of the lanced but not roll formed or expanded sheet metal from which the lath sheet of FIG. 1. is made.

The details of the structure of the presently preferred embodiment of lath sheet 10 will become apparent from an understanding of the generalized process by which lath sheet 10 is manufactured commencing with a piece of sheet metal stock 15. Referring to FIG. 10, an initial step in the manufacture of the lath sheet is the lancing of stock sheet 15 by the use of suitable dies in a punchpress or the like. The dies operate upon stock sheet 15 to define in the sheet a series of slits or linear lances 20 in a generally herringbone pattern over the width and length of the stock sheet. Each slit 20 is disposed in a colinear relation with two other slits, as along line 21 as shown in FIG. 10. Each set of three linearly aligned slits 20, as a result of the expansion process in manufacture of lath sheet 10, is developed into a trapezoidally shaped opening 40 in a corresponding row 19 in a set 18 of longitudinal rows of such openings. Proceding across the width of stock sheet 15, alternate ones of slit lines 21 are disposed equally but oppositely obliquely relative to the length of the stock sheet. Accordingly, there are six longitudinal zones 23 in the stock sheet in which the slit lines slope left to right proceding from bottom to top along the sheet, and six alternate zones 24 in which the slits lines slope right to left from bottom to top along the length of the sheet. The angle of slope of each slit line 21 relative to a reference line 22, parallel to the length of the stock sheet, is angle "K" as depicted in FIG. 10. Thus, in zone 23, for example, of the lanced stock sheet, the slit lines 21 slope left to right, whereas in alternate zones 24 the slit lines slope right to left relative to longitudinal reference lines 22. In each zone, 23 or 24, the slit lines are parallel to each other and are spaced equally apart from each other by a distance "2H" where "H", as shown in FIG. 10, is the distance of offset (in a direction parallel to a reference line 22) between one end of a slit line 21 in a zone 24 relative to the closest adjacent end of a slit line in the adjacent zone 23. The adjacent ends of the slit lines, in zones on opposites sides of a longitudinal reference line 22, are spaced from each other by a dimension "G" measured transversely of the length of stock sheet 15. As represented in FIG. 10, dimension "I" (the distance between adjacent ends of the slit lines in any given zones) is equal to two times dimension "H". Slits 20 are formed in stock sheet 15 so that there is an unlanced edge margin 25 and 26 along each longitudinal edge of the stock sheet; each margin has a width of dimension "J". Stock sheet margins 25 and 26 are processed during manufacture of lath sheet 10 to define lath sheet edge margins 11 and 12, respectively. Similarly, each of the eleven unlanced longitudinal areas between adjacent slitted zones 23 and 24 is processed during manufacture of the lath sheet to define a corresponding one of longitudinally extending stiffening ribs 17.

The dimensions "A" (see FIG. 2) and "B" through "K" (see FIG. 10) are set forth in the following table pertinent to the presently preferred embodiment of a sheet of expanded metal lath according to this invention:

A. 3.031 inches
B. 1.9722 inches
C. 0.7861 inches
D. 3.69 inches
E. 1.1784 inches
F. 0.0774 inches
G. 0.200 inches
H. 0.125 inches
I. 0.250 inches
J. 0.370 inches
K. 12.3°

In the foregoing table the dimensions are described as follows:

A. The centerline to centerline distance, transversely of the width of sheet 10, between adjacent longitudinal stiffening ribs 17;
B. The distance transversely of the lanced but unexpanded stock sheet 15 between corresponding ends of corresponding slit lines 21 in one of zones 23 or 24 to the next adjacent one of such zones;
C. The maximum dimension subtended transversely of the length of stock sheet 15 by a single slit line 21, regardless of the zone in which it occurs;
D. The overall length of a slit line 21;
E. The length of each slit 20 in a given slit line 21;
F. The distance along a given slit line between the proximate ends of adjacent slits;
G. The dimension transversely of the length of stock sheet 15 of the unslit area between adjacent zones 23 and 24, or 24 and 23;
H. See preceding description;
I. See preceding description;
J. The unslit width of the stock sheet along each longitudinal margin thereof; and
K. The angle of slope or inclination clockwise or counterclockwise, i.e. left or right, relative to the longitudinal center line 22 of an unslit zone having width G, in the lanced but unexpanded stock sheet 15.

Figure 6:
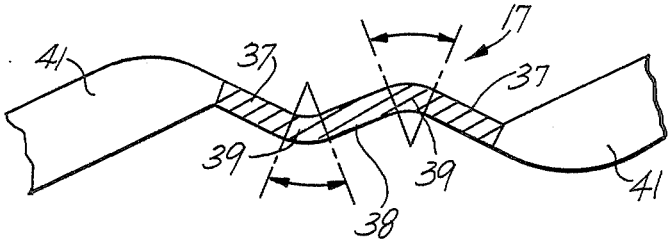
FIG. 6 is an enlarged cross-sectional elevation view of a longitudinal stiffening rib of the lath sheet shown in FIG. 1, as in area "6" in FIG. 5, after expansion of the lanced sheet metal stock.
Figure 7:
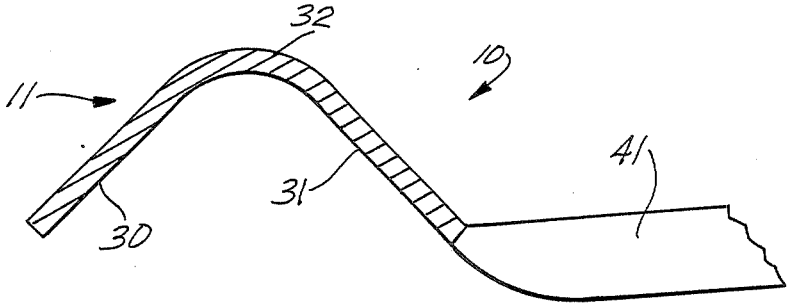
FIG. 7 is an enlarged cross-sectional elevation review of the sheet edge margin shown in area "7" in FIG. 5.
Figure 8:
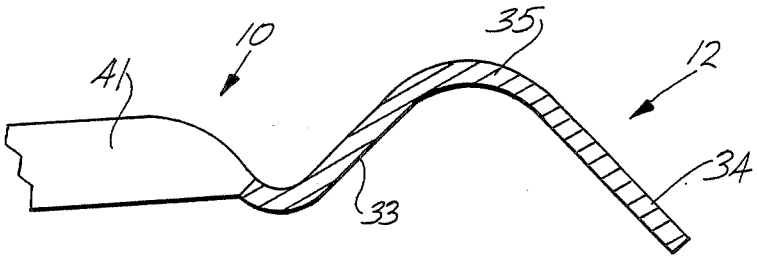
FIG. 8 is an enlarged cross-sectional elevation view of the opposite edge margin taken along line 8—8 in FIG. 2.
Figure 9:
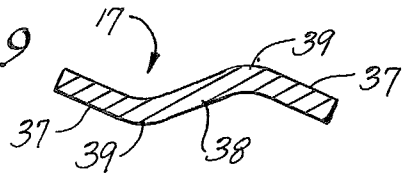
FIG. 9 is an enlarged cross-sectional elevation view, similar to FIG. 6, of the unlanced portion of the sheet defining a longitudinal stiffening rib after roll forming but before expansion of the metal from which the lath sheet of FIG. 1 is made.

After stock sheet 15 has been fully lanced over its length and width in the manner indicated in FIG. 10, it is subjected to a roll forming operation in which edge margins 25 and 26 of the stock sheet are given the contours shown in FIGS. 7 and 8, thereby to define edge margins 11 and 12 of lath sheet 10. Also, at the same time, the unlanced areas along longitudinal lines 22 of the stock sheet are rolled to take on the cross-sectional configuration shown in FIG. 9 so that, upon final expansion of the rolled and lanced stock sheet, these areas define the longitudinally extending, transversely effective reinforcing ribs 17 illustrated in cross-sectional detail in FIG. 6.

Lath sheet edge margins 11 and 12 have cross-sectional configurations which mate with each other for positional location and interrelation of adjacent lath sheets as applied to the rough framing of a wall, for example, in such manner that the edge margins of the adjacent sheets extend perpendicular to the elongate extent of the several studs to which the two lath sheets are connected. Accordingly, lath sheet edge margin 11 has an outer portion 30 which is inclined at a selected angle relative to an inner portion 31. Both of portions 30 and 31 are flat and are coupled by an interconnecting bend 32 of selected radius. Similarly, edge margin 12 of lath sheet 10 has a flat inner portion 33, and a flat outer portion 34, which are coupled by a bend portion 35 having the same radius as bend portion 32 of lath sheet edge margin 11. The included angle between flat portions 30 and 31 of edge margin 11 is equal to the included angle between the flat portions 33 and 34 of edge margin 12.

In its as-rolled cross-sectional configuration, each longitudinal stiffening rib 17 is defined as a pair of flat rib edge portions 37 and a flat rib central portion 38. The rib edge portions are substantially parallel to each other but are non-coplanar and non-overlapping. They are connected to the rib central portion 38 by corresponding bend areas 39 which are geometrically similar but reversed relative to each other. Thus, each rib 17 has a generally "Z" configuration.

After rolling in the manner described above to define the lath sheet edge margin configurations and stiffening rib configurations (see FIGS. 7, 8 and 6, respectively), the stock sheet 15 is placed in an expansion mechanism which operates upon the stock sheet to apply to it forces which act transversely of the length of the stock sheet and in opposite directions outwardly of the longitudinal center line of the stock sheet. In response to such outwardly directed transverse forces applied to the stock sheet, the sheet metal of the stock sheet deforms in the vicinity of the adjacent ends of slits 20 in adjacent slit lines 21 in each of zones 23 and 24 of the stock sheet. The result is that the stock sheet grows in width from its unlanced dimension to its finished dimension, and in the process each slit 20 expands and opens to define a corresponding one of each of openings 40 as shown in detail in FIGS. 2 and 3. Each opening 40 is of substantially trapezoidal configuration, and has a pair of parallel long sides 41 and a pair of parallel short sides 42 see (FIG. 2).

Figure 2:
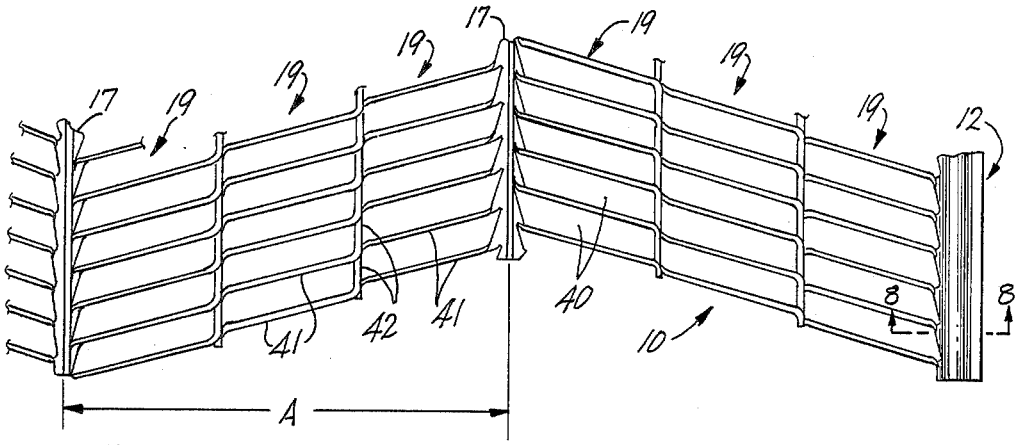
FIG. 2 is an enlarged fragmentary plan view of the portion of the expanded metal lath sheet in area "2" as indicated FIG. 1.
Figure 3:
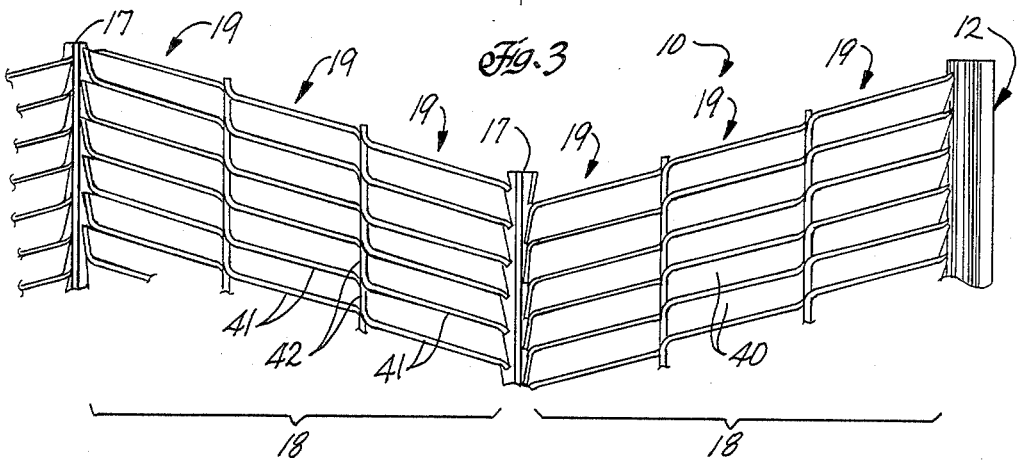
FIG. 3 is a view of the reverse side of the portion of the expanded metal sheet shown in FIG. 2.
Figure 4:
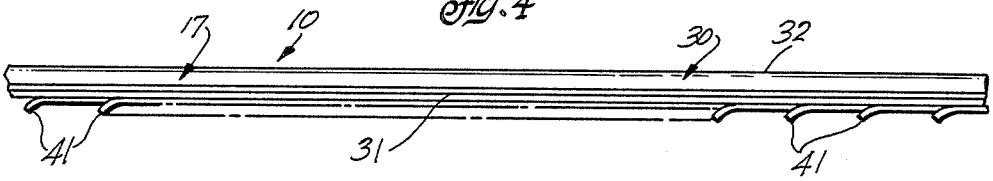
FIG. 4 is a fragmentary side elevation view of the sheet shown in FIG. 1 has taken along the left longitudinal edge of the sheet.
Figure 5:
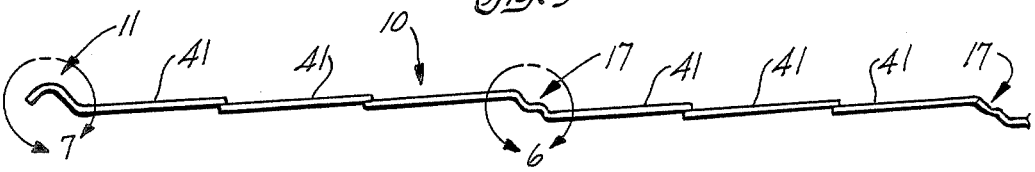
FIG. 5 is a fragmentary transverse elevation view of the sheet shown in FIG. 1 as taken along line 5—5 in FIG. 1.

In the finished expanded metal lath sheet 10, the metal defining each of the long sides of each opening 40 is disposed substantially perpendicular to the basic plane of the lath sheet so that, as seen in FIGS. 2 and 3, the metal separating adjacent ones of openings 40 in each row 19 is essentially the thickness of the stock sheet, whereas the dimension of each opening long side 41 normal to the view of FIGS. 2 and 3 corresponds to the distance between adjacent ones of slit lines 21 as measured perpendicular to the elongate extent of each of those lines. The portion of the expanded lath sheet which defines the short ends 42 of the openings 40 in adjacent rows of openings (other than those short ends associated with either of edge margins 11 or 12 or any of stiffening ribs 17) are common to each other and, as seen in FIG. 3, also have dimensions corresponding substantially to the thickness of stock sheet 15.

Preferably, in the presently preferred expanded metal lath sheet according to this invention, the dimensions of each opening 40 in sheet 10 is substantially one inch as measured along the long side of each opening, whereas the width of each opening, as measured perpendicular to the long sides, is substantially 7/32 of an inch.

Because of the herringbone manner in which slits 20 are defined in stock sheet 15, it will be apparent that openings 40 are disposed in a herringbone manner relative to each other on opposites sides of each of longitudinal stiffening ribs 17 in the finished article.

In the finished article, each longitudinal stiffening rib 17 preferably has edge 37 and central 38 portions which have substantially equal widths transversely of the elongate extent of the rib. Preferably, these widths are substantially equal to three times the thickness of the sheet. More specifically, each of rib edge and central portions 37 and 38 have widths, in their respective planes transversely in the elongate extent of the rib, of approximately 0.049 inches, whereas the preferred thickness of stock sheet 15 is 0.015 inches. The arc of each of bend portions 39 in each rib 17 is approximately 45 degrees. Stiffening ribs 17 provide adequate resistance to deflection when the lath is mounted across studs spaced 16 to 24 inches on center and normal levels of force, associated with the application of plaster or the like by hand or by discharge from a nozzle, are applied to the lath sheet.

Presently preferred lath sheet 10, according to this invention, has a weight per unit area of substantially 1.8 pounds per square yard of sheet area. The present best industry standard for expanded metal lath is a weight per unit area of approximately 2.25 pounds per square yard. Furthermore, lath sheet 10 has a width of 36 to 36½ inches between the outer extremities of longitudinal edge margins 11 and 12, whereas present industry standard is 27 inches or so.

It is presently preferred that lath sheet 10 be manufactured from galvanized sheet metal stock which, before galvanization, has a thickness of 0.015 inches. Lath sheet 10 has a very high degree of openness which is consequence of its low weight per unit area. The openness of the presently preferred embodiment of the expanded metal lath, according to this invention, is approximately 70%. Steel has a density of 0.283 pounds per cubic inch; one square yard of 0.015 inch thick steel sheet would weigh 5.50 pounds per square yard. However, the present 1.8 pound per square yard expanded metal lath has a weight per square yard which is only 33.7% of an equal area of the ungalvanized sheet steel from which the lath sheet is made. If the lath sheet were made of ungalvanized sheet metal stock it would have an openness of about 67.3%. However, since the stock sheet is galvanized, it necessarily weighs somewhat more than 5.50 pounds per square yard. Based upon the forgoing calculations, it is estimated that galvanized lath sheet 10 has an openness factor of about 70%.

Lath sheet 15 has adequate structural integrity to withstand normal handling without creasing of kinking. It has rather large openings, but they are so proportioned that applied plaster or the like does not pass overly through the sheet when application forces are in the range of normal. The larger overall dimensions of the sheet enable a given area of wall to be lathed faster by use of fewer sheets, thus providing advantages to the user. The reduced weight of the lath per unit area is of advantage to the user because the lath is readily handled, and it is of benefit to the manufacturer whose raw material costs are reduced.

The prededing description has been presented with reference to a single presently preferred embodiment of the invention. Workers skilled in the art to which the invention pertains will appreciate that, commensurate with the scope of the advances in that art made by this invention, departures from and variations of the structure described may be practiced without departing from the scope of the invention. Therefore, the foregoing description is not restricted to the precise structure described and shown, and the following claims are to be read in that light.

What is claimed is:

1. An article of manufacture comprising expanded metal lath useful as a construction material to serve as a substrate and reinforcement for plaster applied thereto, the article being provided as a substantially rectangular lanced and expanded metal sheet of selected length and width dimensions, the article having a width substantially greater than an unexpanded metal sheet from which the article is manufactured, the article having unexpanded edge margins of selected width along each longitudinal edge, the article between the edge margins defining longitudinal rows of similar substantially trapezoidally shaped openings disposed transversely of the article, the article also defining between the edge margins a plurality of rib constructions which are disposed parallel to the edge margins and which extend between the ends of the article and which are spaced at regular intervals across the width of the article between selected rows of openings, each rib construction having along the length thereof a three dimensional stiffening contour which, in cross-section transversely of the length of the article, is of generally "Z" configuration having two spaced substantially parallel but non-coplanar and non-overlapping rib edge portions interconnected by a rib central portion disposed obliquely to the rib edge portions, each rib edge portion being connected to the adjacent rib central portion by a bend portion which subtends an arc of substantially less than a right angle.

2. An article of manufacture according to claim 1 wherein the article edge margins are unexpanded, and the article has an openness figure of substantially 70%.

3. An article of manufacture according to claim 1 wherein each edge margin of the article is transversely contoured to define a longitudinally extending, transversely effective stiffener in the article.

4. An article of manufacture according to claim 3 in which each edge margin has a contour defined to mate with the contour of either edge margin of the another similar article.

5. An article of manufacture according to claim 1 wherein the rib construction bend portions substituted arcs are of substantially 45°.

6. An article of manufacture according to claim 1 wherein the edge and the central portions of the rib constructions are essentially flat over their respective extents transversely of the article.

7. An article of manufacture according to claim 6 wherein the width transversely of the article of each edge portion and the central portion of a rib construction is substantially three times the thickness of the metal sheet.

8. An article of manufacture according to claim 1 wherein the long sides of each opening are substantially one inch and the distance normally between the opening long sides is substantially 7/32 inch.

9. An article of manufacture according to claim 8 wherein the sheet has an unexpanded thickness of substantially 0.015 inch, and the article has a weight of substantially 1.8 pounds per square yard of area.

10. An article of manufacture according to claim 9 wherein the article has a width of substantially 36 inches.

11. An article of manufacture according to claim 9 wherein the article is made from galvanized sheet steel

12. An article of manufacture comprising expanded metal lath useful as a construction material to serve as a substrate and reinforcement for plaster applied thereto, the article being provided as a substantially rectangular lanced and expanded metal sheet of selected length and width dimensions and having an unexpanded thickness of substantially 0.015 inch, the article having a width substantially greater than an unexpanded metal sheet from which the article is manufactured, the article having unexpanded edge margins of selected width along each longitudinal edge, each edge margin being contoured transversely of the article to define a transversely effective stiffener and each stiffener is contoured to mate with the contour of either edge margin of another similar article, the article between the edge margins defining longitudinal rows of similar substantially trapezoidally shaped openings in which the long side of each opening are disposed substantially transversely of the article, the long side of each opening having a length of substantially one inch and the distance normally between the long sides of each opening is substantially 7/32 inch, the article having a width of substantially 36 inches and a weight of substantially 1.8 pounds per square yard of area, the article also defining between the edge margins a plurality of rib constructions which are disposed parallel to the edge margins and which extend between the ends of the article and which are spaced at regular intervals across the width of the article between selected rows of openings, each rib construction having along the length thereof a three-dimensional stiffening contour which, in cross-section transversely of the length of the article, is of generally "Z" configuration having two spaced substantially flat and substantially parallel but non-coplanar and non-overlapping rib edge portions interconnected by a substantially flat rib central portion disposed obliquely to the edge portions via bend portions which have arcs of substantially 45°, the rib edge and the central portions having widths transversely of the article which are substantially three times the thickness of the unexpanded metal sheet.

13. An article of manufacture according to claim 12 wherein the openings on opposite sides of each rib construction have their long sides angled oppositely and substantially equally relative to the width of the article, whereby the openings are defined in the article in a herringbone pattern.

14. An article of manufacture according to claim 13 wherein there are plural rows of openings between the adjacent rib constructions and between each edge margin and the adjacent rib construction.

15. An article of manufacture according to claim 14 wherein there are three rows of openings between at least some of the rib constructions.

* * * * *

UNITED STATES PATENT AND TRADEMARK OFFICE

CERTIFICATE OF CORRECTION

PATENT NO. : 4,734,337

DATED : March 29, 1988

INVENTOR(S) : Patton

It is certified that error appears in the above-identified patent and that said Letters Patent is hereby corrected as shown below: Title Page:

Abstract, line 10, "non-coplaner" should read -- non-coplanar -- .

Col. 1, line 18, "cementitous" should read -- cementitious --; Col. 1, line 24, cancel "is" (second occurrence); Col. 1, line 57 "looked" should read -- locked -- .

Col. 2, line 8after "and" insert -- the --;(2nd occurr) Col. 2, line 31 "manufacture" should read-- manufacturer -- .

Col. 3, line 8 "manufacture's" should read -- manufacturer's -- .

Col. 4, line 7, after "indicated" insert-- in -- ; Col. 4, line 11, "has" should read -- as -- ; Col. 4, line 20, "review" should read -- view -- ; Col. 4, line 32, change "1." to -- 1 --

UNITED STATES PATENT AND TRADEMARK OFFICE

CERTIFICATE OF CORRECTION

PATENT NO. : 4,734,337

DATED : March 29, 1988

INVENTOR(S) : Patton

It is certified that error appears in the above-identified patent and that said Letters Patent is hereby corrected as shown below:

Col. 5, line 16, "Proceding" should read-- Proceeding -- ; Col. 5, line 22, "proceding" should read -- proceeding -- ; Col. 5, line 24, "slit" should read -- slits -- .

Col. 7, line 21, "see (FIG. 2)" should read -- (see FIG. 2) -- .

Col. 8, line 26, "forgoing" should read-- foregoing -- ; Col. 8, line 29, "of" should read -- or -- Col. 8, line 40, "prededing" should read -- preceding -- .

Col. 9, line 21, claim 4, delete "the", second occurrence Col. 9, lines 24-25, claim 5, change "portions substituted arcs are" to -- portions subtend arcs of -- Col. 9, line 47, claim 11, after "steel" insert -- . -- .

Col. 10, line 14, claim 12, "side" should read -- sides --

Signed and Sealed this

Fifteenth Day of November, 1988

*Attest:*

*Attesting Officer*

DONALD J. QUIGG

*Commissioner of Patents and Trademarks*